United States Patent [19]

Bray

[11] Patent Number: 4,590,872

[45] Date of Patent: May 27, 1986

[54] AUTOMATIC LABEL EMPLACER AND DISPENSER FOR SEWING MACHINES

[76] Inventor: Murel B. Bray, 1509 Meadowview, El Paso, Tex. 79915

[21] Appl. No.: 756,286

[22] Filed: Jul. 18, 1985

[51] Int. Cl.[4] ..... D05B 3/20

[52] U.S. Cl. ..... 112/121.12; 112/121.11; 112/113; 414/752; 271/11; 156/DIG. 31

[58] Field of Search ..... 112/113, 104, 121.11, 112/121.29, 121.12; 414/752, 750; 271/5, 11, 14; 156/DIG. 31, DIG. 38

[56] References Cited

U.S. PATENT DOCUMENTS

| | | | |
|---|---|---|---|
| 3,170,423 | 2/1965 | Henebry | 112/121.12 |
| 3,474,747 | 10/1969 | Noiles | 112/121.12 |
| 4,186,918 | 2/1980 | Ficker et al. | 271/5 X |
| 4,305,338 | 12/1981 | Adamson | 112/113 |
| 4,505,467 | 3/1985 | Brocklehurst | 271/11 X |
| 4,509,638 | 4/1985 | Kato | 414/752 X |

*Primary Examiner*—Werner H. Schroeder
*Assistant Examiner*—Andrew M. Falik
*Attorney, Agent, or Firm*—Leonard Bloom

[57] ABSTRACT

An automatic label emplacer is designed for easy attachment to a commercially-available lock-stitch sewing machine. The label emplacer comprises an improved label dispenser which cooperates with a simplified pressure frame that allows for a 360° or more stitching path circumscription of the label. Operation of the label emplacer is pneumatically and mechanically controlled.

17 Claims, 17 Drawing Figures

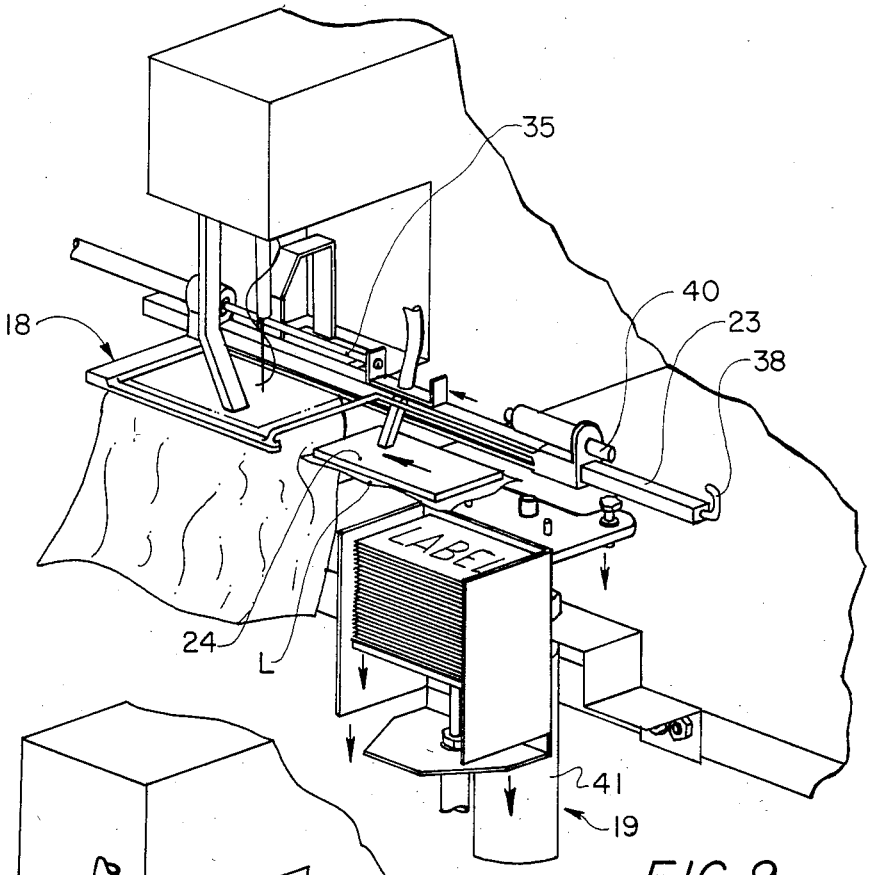
FIG. 9
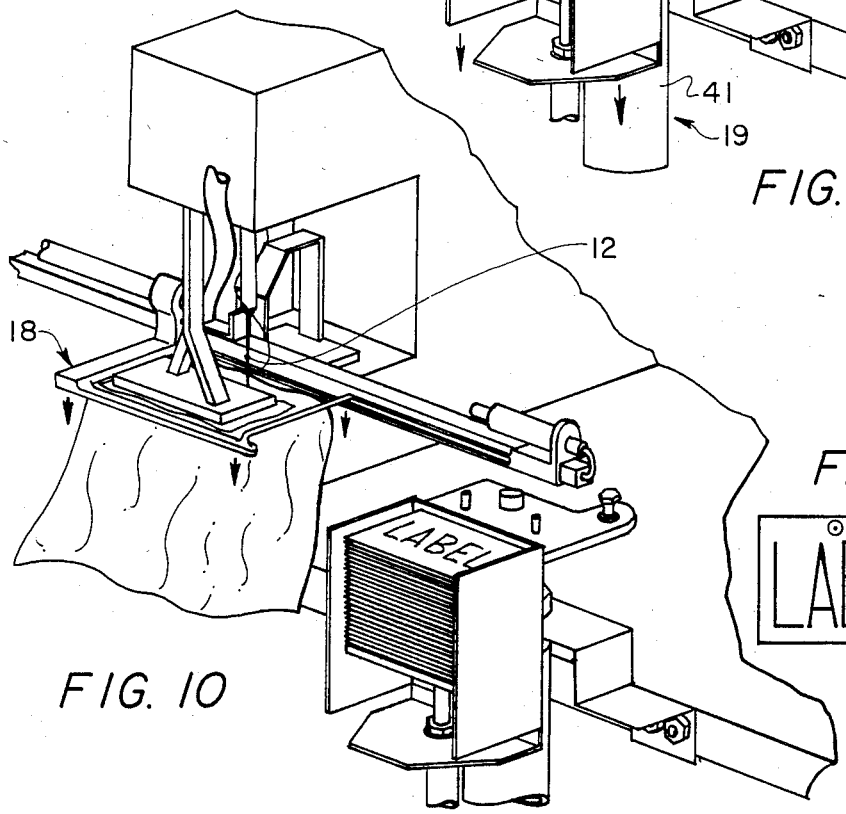
FIG. 10
FIG. 14
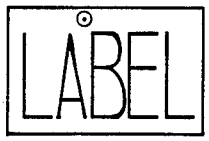

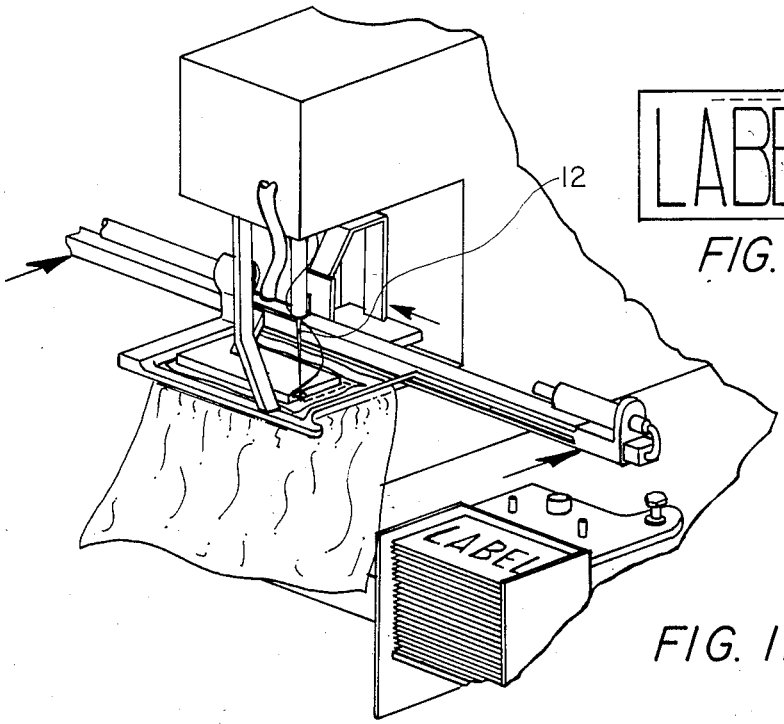
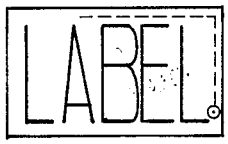
FIG. 15
FIG. 11
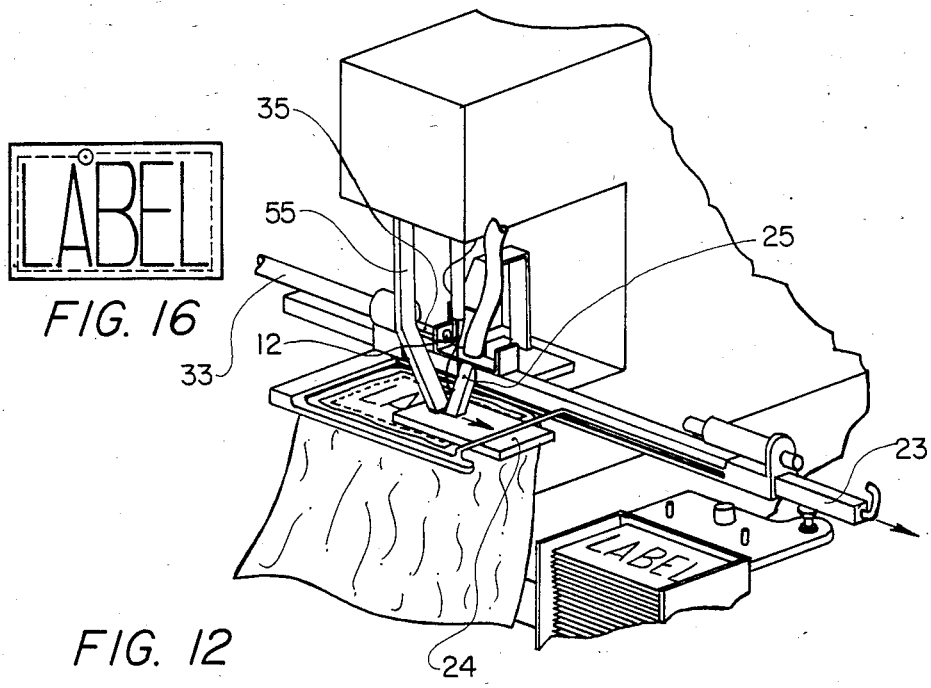
FIG. 16
FIG. 12

AUTOMATIC LABEL EMPLACER AND DISPENSER FOR SEWING MACHINES

FIELD OF THE INVENTION

This invention relates to a handling device for feeding labels to a sewing machine, and more particularly, to a pneumatically and mechanically controlled device for positioning a label for a subsequent sewing operation.

BACKGROUND OF THE INVENTION

Previously, such label handling devices employed rather complex mechanisms for transferring the label from a magazine and holding the same by means of a vacuum pad device within a frame member, the latter usually provided with movable linkage pins or a rotatable connecting rod to allow the stitching needle to circumscribe the label more than 360°, that is, provide a stitching overlap on the label.

These prior art devices required a complex linkage system for removing the support pins, connecting rod, or frame out of the path of the stitching needle, so that the latter could complete a 360° or more sewing path around the edge of the label. Otherwise, without such a linkage removal means, the sewing path could not extend the full 360° or more; and as a result, the terminal portion of the sewing path would not be lock stitched by means of the desired overlap.

SUMMARY OF THE INVENTION

Accordingly, it is an object of the present invention to alleviate the aforementioned problem and deficiencies of the prior art by providing a simplified automatic label emplacer that allows for a 360° or more sewing path circumscription of the label, yet without the necessity for the complex linkage removal means of the prior art.

It is another object of the present invention to provide a label emplacer for attachment to a commercially-available lock-stitch sewing machine for sewing labels on various workpieces in the garment industry.

It is yet another object of the present invention to provide a simplified label emplacer that readily accommodates different label sizes in accordance with the alignment and programming of the sewing machine to which the label emplacer is attached.

It is a further object of the present invention to provide an improved label dispenser for cooperation with the label emplacer attachment.

It is a still further object of the present invention to provide a label emplacer attachment for a sewing machine, which is economical to produce, and which is rugged and reliable for substantially maintenance-free operation.

The present invention finds particular utility on an industrial sewing machine of the type having a platen for supporting a workpiece, a reciprocating needle, a carrier means, and a supply of labels. In accordance with the teachings of the present invention, the label emplacer includes a means for dispensing labels from the label supply, and further includes a pressure frame mounted on the carrier means. Means are provided, including a label pressure foot, for selecting one of the labels from the label dispensing means, and means are further provided for transferring the label pressure foot and the one selected label to a stitching position within the pressure frame. The pressure frame along with the label pressure foot are depressed to securely retain the workpiece to the platen and the label to the workpiece, respectively; and the pressure frame and the label pressure foot are moved as a unit, substantially in a rectangular pattern, as the label is stitched to the workpiece by the reciprocating needle.

These and other objects of the present invention will become apparent from a reading of the following specification, taken in conjunction with the enclosed drawings.

BRIEF DESCRIPTION OF THE DRAWINGS

FIGS. 7–13 are schematic sequential views of the label emplacer in operation.

FIGS. 14–17 are plan outlines of the label, sequentially showing the stitching of the label to the garment or other workpiece.

DESCRIPTION OF THE PREFERRED EMBODIMENT

Figure 1:
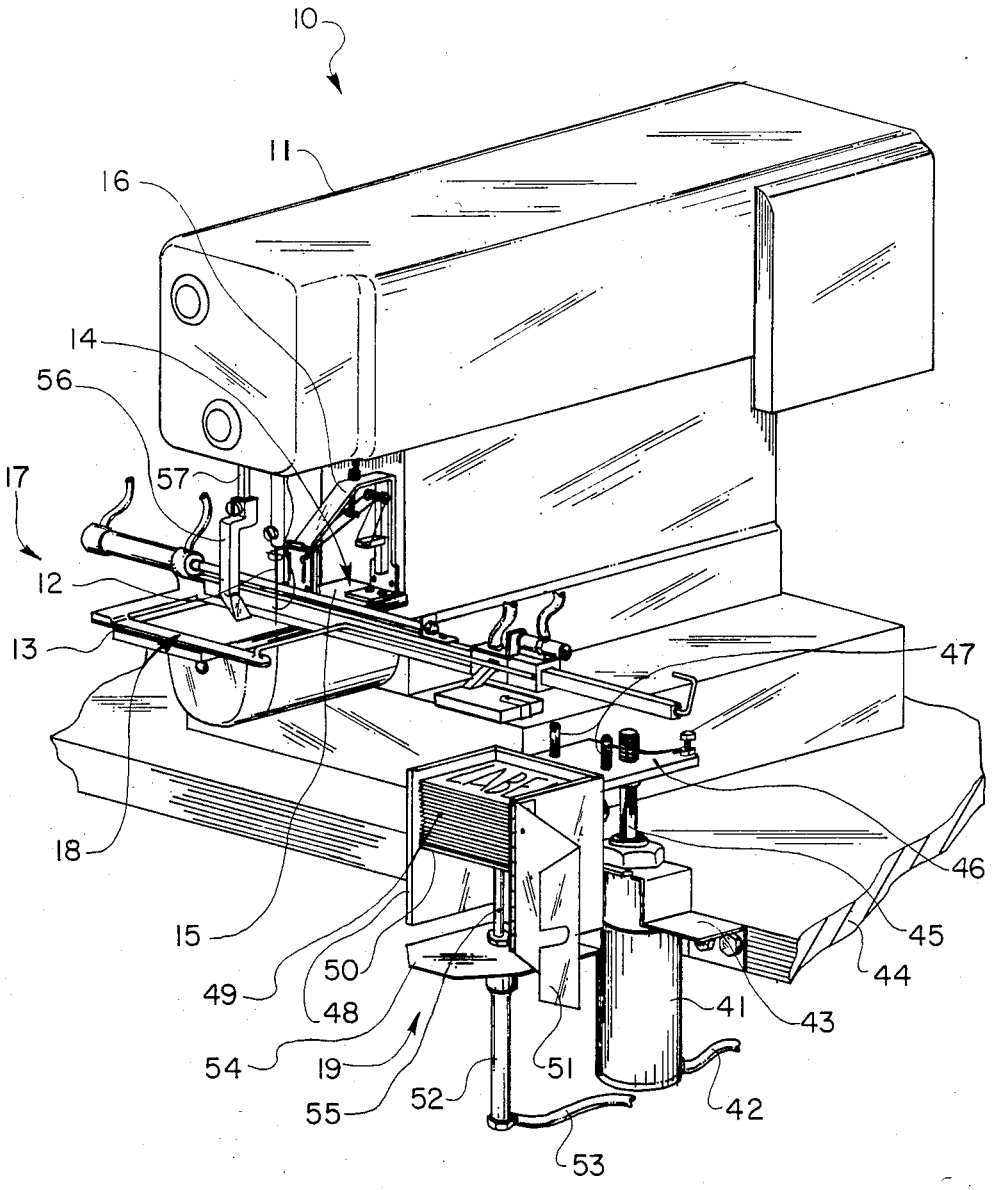
FIG. 1 is a perspective view of the label emplacer of the present invention shown attached to a standard industrial sewing machine.

With reference to FIG. 1, a conventional industrial sewing machine 10 is shown. The machine 10 may consist of a Mitsubishi sewing machine model 109064, but it is to be understood that the present invention is not limited to use thereon. The sewing machine is provided with a conventional sewing head 11 carrying a reciprocating needle 12 in the usual manner. Disposed beneath the forward end of the sewing head is a platen 13 for supporting a workpiece. A carrier means 14 is provided which includes a carrier plate 15 and an overhanging brace 16. The platen is mounted on the front portion of the carrier plate. The overhanging brace is mounted on the back of the plate and extends forward over the platen to support the label emplacer 17. In this manner, the label emplacer and platen can be laterally shifted in unison during the stitching process.

Figures 2, 4:
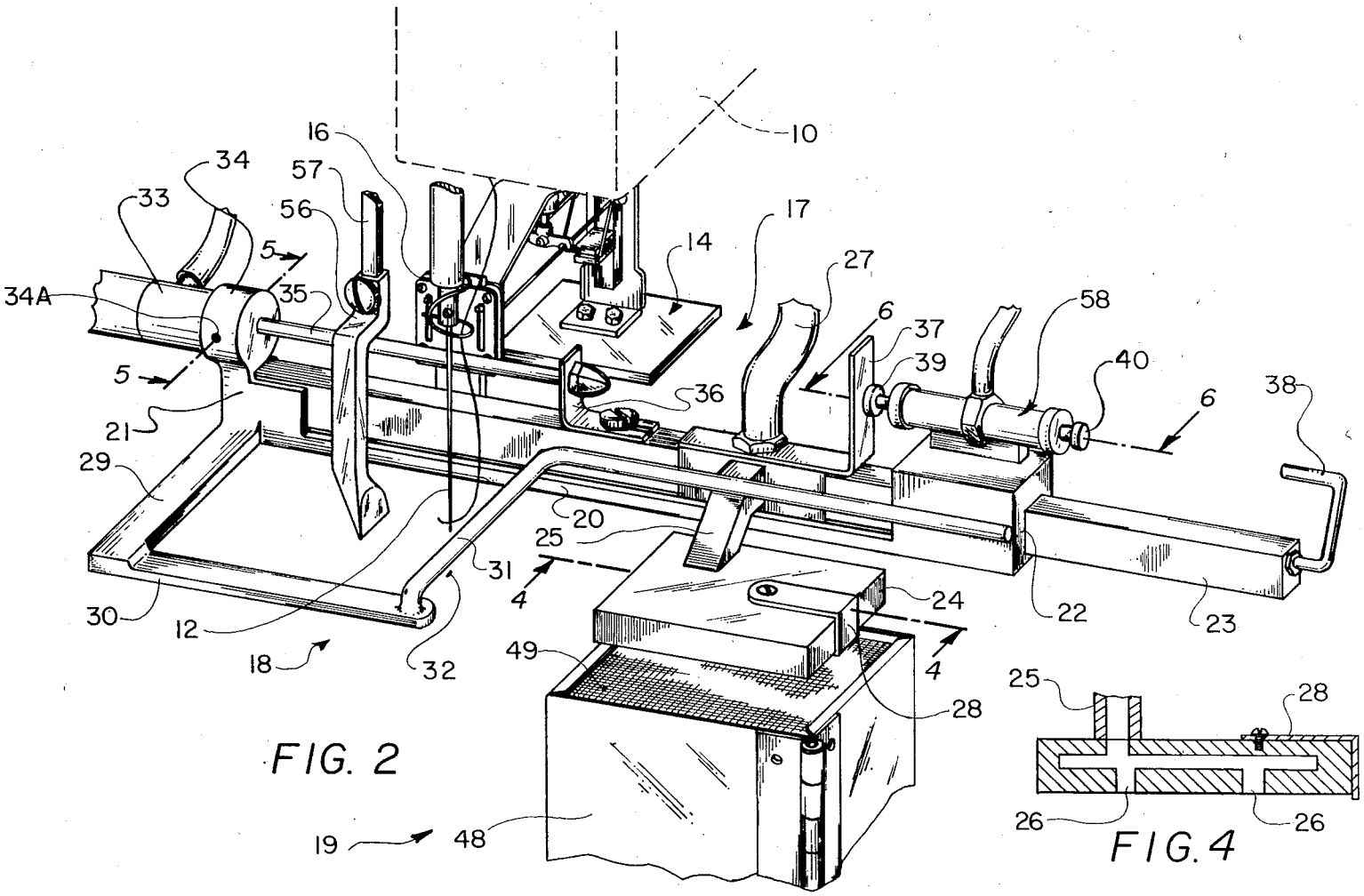
FIG. 2 is an enlarged perspective view of the label emplacer shown in FIG. 1.
FIG. 4 is a cross-section of the label pressure foot of the label emplacer taken across the line 4—4 of FIG. 2.
Figure 3:
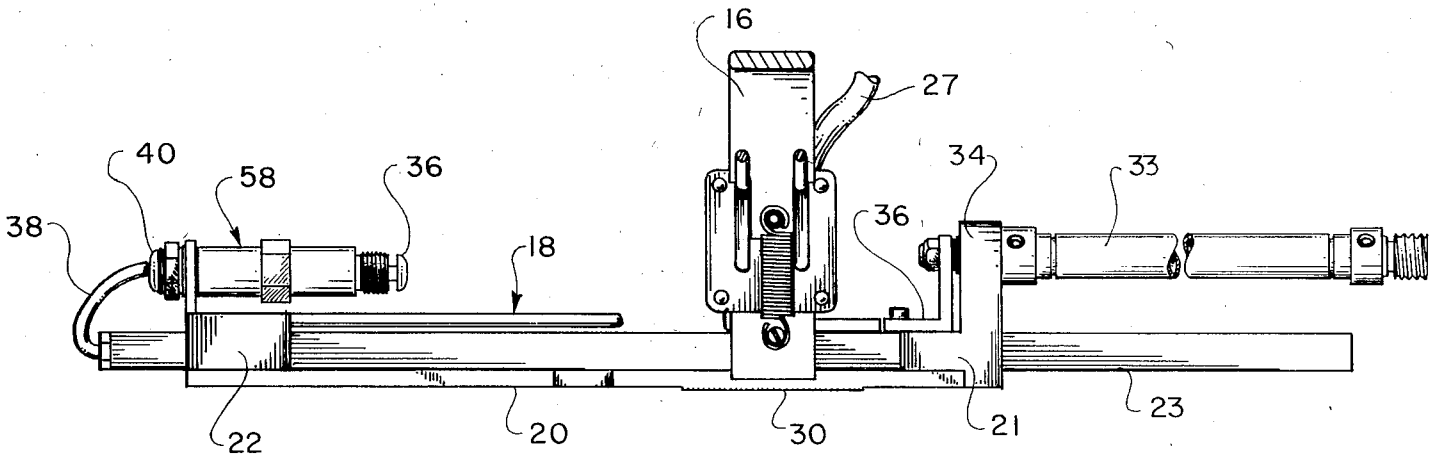
FIG. 3 is a rear elevation of the label emplacer shown in FIG. 1.

With further reference to FIGS. 2 and 3, the label emplacer comprises a pressure frame 18 and a label dispenser 19. The pressure frame includes an extension arm 20. The extension arm is a substantially elongated flat bar transversely mounted on the carrier means. Positioned on either end of the extension arm are first and second upstanding bosses, 21 and 22, respectively. These bosses have aligned guideways (preferably of substantially square cross section) through which a square guide bar 23 is slidably guided over the extension arm. A label pressure foot 24 is mounted on the guide bar intermediate of the first and second upstanding bosses. A vacuum conduit 25 connects the label pressure foot to the guide bar.

With further reference to FIG. 4, the label pressure foot is formed preferably as a rectangular piece having a flat bottom surface provided with at least one orifices 26. An auxiliary label pressure spring 28 is carried by the top surface of the label pressure foot. The spring 28 is a flat piece having a bent portion which hangs over the top edge of the label pressure foot and extends slightly beyond the bottom edge thereof to facilitate holding the label, along with the vacuum pressure, to a workpiece. The vacuum is directed to the label pressure foot through the vacuum conduit and the guide bar. The guide bar has a communicating aperture therein which is connected to a vacuum source (not shown) through a line 27 mounted on the guide bar.

A brace member 29 is mounted on the side of the first upstanding boss and extends laterally therefrom substantially perpendicularly, of the extension arm. The protruding end of the brace member is connected to a first end of a pressure foot 30. The pressure foot is substantially parallel to the extension arm and is spaced therefrom a distance substantially equal to the length of the brace member. A second end of the pressure foot is connected to an L-shaped stabilizer arm 31. The shorter leg of the stabilizer arm is attached to the pressure foot and is substantially parallel with the brace member. The longer leg of the stabilizer arm is connected to the side of the second upstanding boss and runs substantially parallel and adjacent to the extension arm. The stabilizer arm is raised above the plane of the pressure frame, thereby forming a slotted opening 32. The slotted opening allows for reciprocable motion of the label pressure foot between the label dispenser and the substantially rectangular enclosure of the pressure frame.

Figure 5:
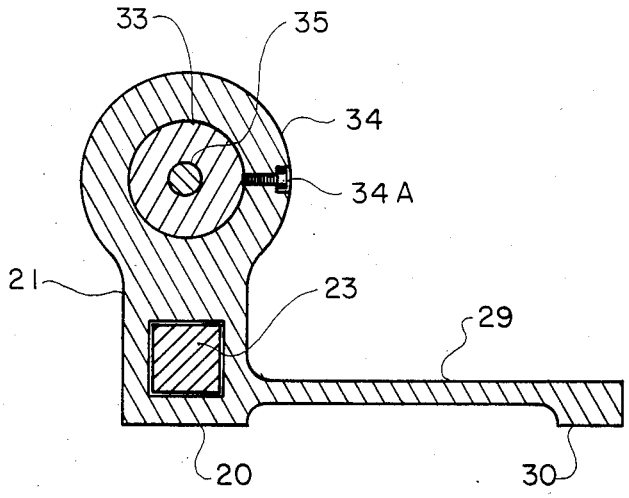
FIG. 5 is a cross section of the pressure frame taken across the line 5—5 of FIG. 2.
Figure 6:
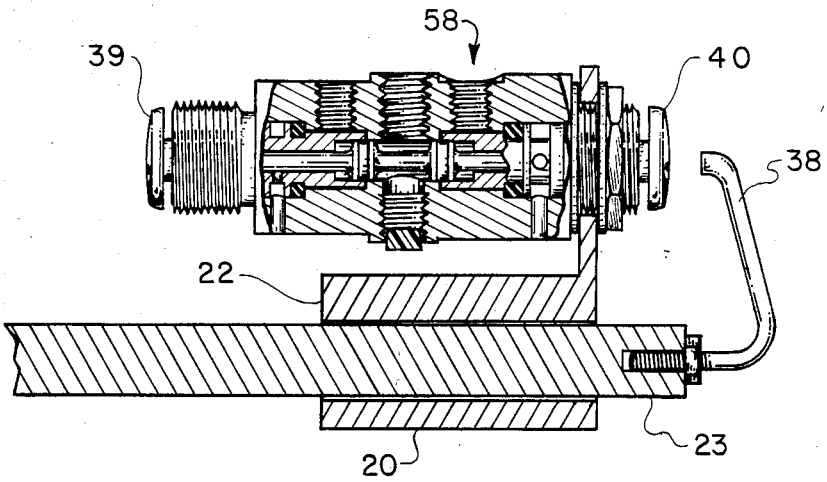
FIG. 6 is a cross section of the pressure frame taken across line 6—6 of FIG. 2.

With reference again to FIG. 2 and with further reference to FIGS. 5 and 6, push-pull pneumatic cylinder 33 is mounted above the first upstanding boss by means of a threaded element 34 and is retained by a set screw 34*a*. The plunger 35 of the pneumatic cylinder is attached to an adjustable bracket 36 secured on the guide bar adjacent to the vacuum line. A stop 37 is also adjustably mounted on the guide bar adjacent to the vacuum line. A deactivation finger 38 is mounted on the end of the guide bar. The stop 37 and deactivation finger 38 are used to activate pneumatic switches 39 and 40 located on a cylinder 58. The pneumatic switches (shown in FIG. 6) are positioned above the second upstanding boss intermediate of the stop and deactivation finger, and are horizontally aligned with the guide bar.

With reference again to FIG. 1, the label dispenser 19 includes a first pressure cylinder 41 which moves the label dispenser vertically. The first pressure cylinder has an air supply 42 and is supported by a first bracket 43 mounted on a table top 44. The piston 45 of the first pressure cylinder is attached to a second bracket 46. The second bracket has two alignment pins 47 protruding on top and supports a label magazine 48. The label magazine contains a stack of labels 49 supported on a pressure platform 50. A hinged door 51 connected to the label magazine is provided for access thereto. A second pressure cylinder 52, having an air supply 53, is mounted on a third bracket 54 below the label magazine. The piston 55 of the second pressure cylinder is attached to the pressure platform. The second pressure cylinder is activated in a vertical direction, thereby maintaining pressure on the stack of labels.

With reference again to FIG. 2, a specially made stationery metal slide finger 56 is mounted on the sewing machine's needle guard bar 57. The slide finger extends down from the guard bar adjacent to the needle. However, the slide finger is bent so that its leading edge protrudes ahead of the needle.

Figure 7:
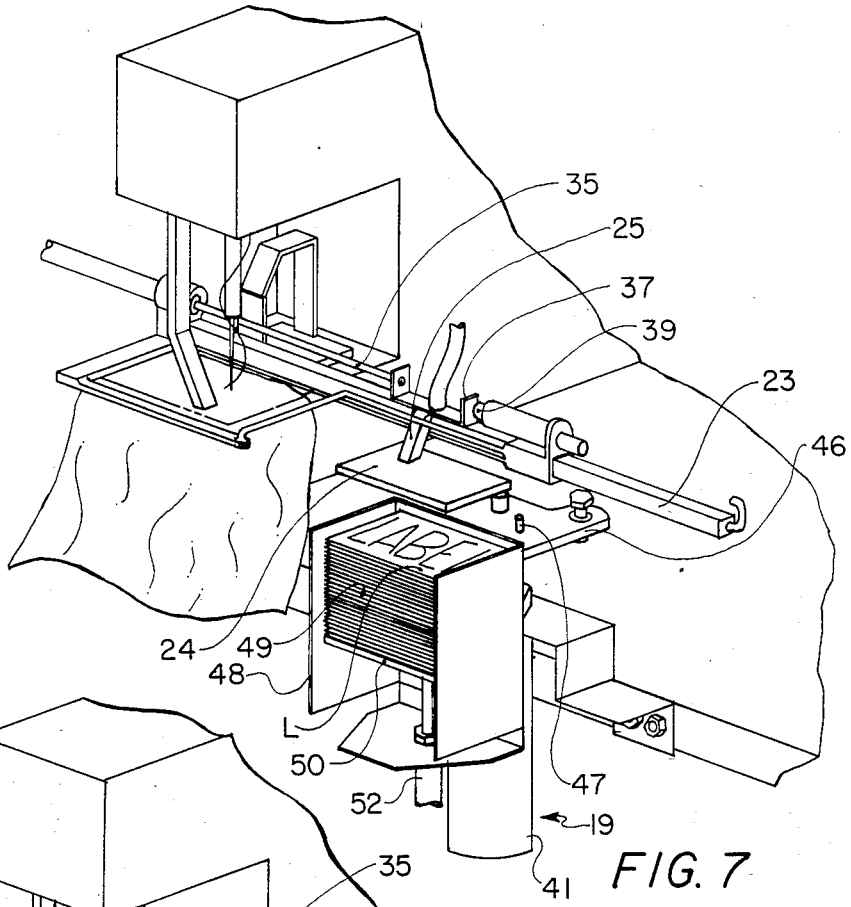
Figure 8:
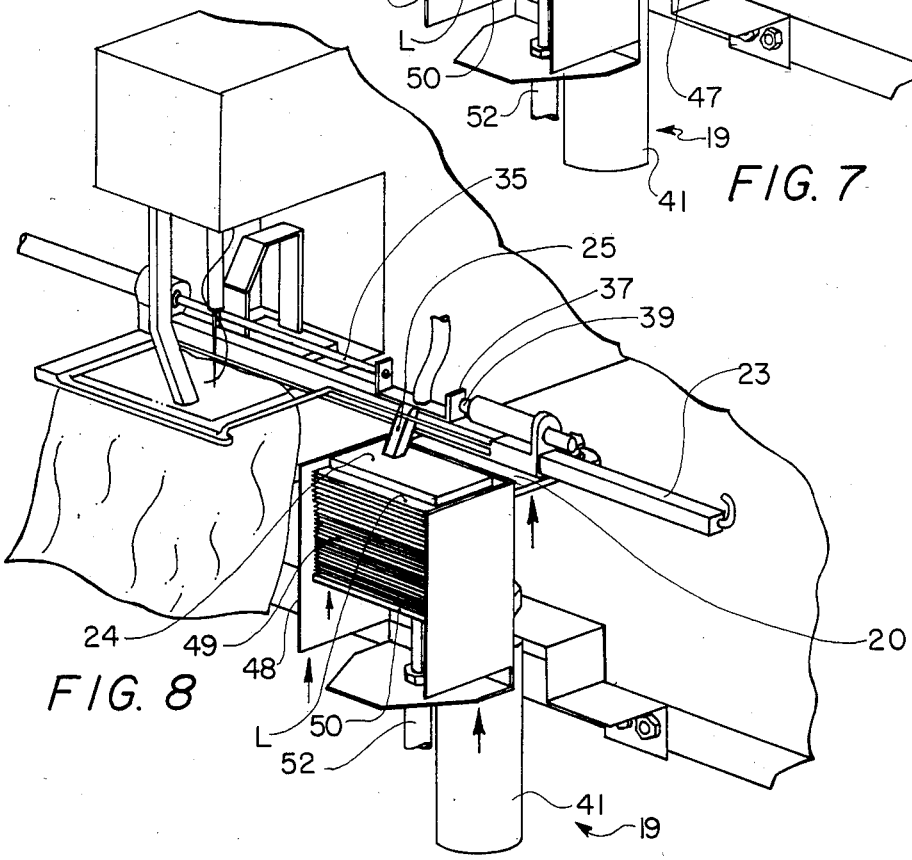

In operation, as shown in FIGS. 7 and 8, the guide bar 23 is shifted to the right by means of the pneumatic cylinder 33, so that the stop 37 activates the switch 39 causing the sewing machine's treadle control to be held inoperative. In the extreme right position, the label pressure foot 24 is aligned directly above the label magazine 48 containing the stack of labels 49. The label dispenser 19, containing the label magazine 48, rises by activation of the first pressure cylinder 41, such that the stack of labels 49 contacts the label pressure foot 24. At the same time, a vacuum is applied (via the vacuum conduit 25) to the orifices 26 on label pressure foot 24, thereby selecting the uppermost label L within the magazine. During the upward movement of the label dispenser 19, two alignment pins 47 on the second bracket 46 make contact with two holes in the extension arm 20, thereby aligning the label pressure foot 24 with the stack of labels 49 contained in the label magazine 48. Moreover, when the stack of labels 49 makes contact with the label pressure foot 24, the second pressure cylinder 52, is activated, thereby applying instant pressure to the stack of labels 49 by way of the pressure platform 50. This aids the vacuum in the label pressure foot to securely select the label L from the label magazine.

As shown in FIG. 9, once the label L has been secured by the label pressure foot 24, the label dispenser 19 returns to its original position by means of the first pressure cylinder 41; and, at the same time, the guide bar 23 is shifted to the left by means of the pneumatic cylinder 33, so that the deactivation finger 38 activates the switch 40 causing the sewing machine's treadle control to be operative. In the extreme left position, the label pressure foot 24 and the secured label L are in a stitching position within the confines of the pressure frame 18.

As shown in FIGS. 10 and 14, upon depression of the sewing machine's treadle control, downward pressure is applied to the pressure frame 18 holding the label L and the item on which the label L is to be stitched. Further downward movement of the treadle control will energize the sewing machine and hold pressure on the pressure frame 18. The pressure frame 18 is laterally shifted by a conventionally programmed controlled hydraulic, mechanical or electrical means (not shown) so that the needle 12 follows the edge of the label (as shown more clearly in FIGS. 11 and 15, repectively).

At approximately 320° from start of stitching, the sewing machine's carrier means 14 makes contact with an air valve (not shown) that removes the vacuum applied to the label pressure foot 24, removes air from the pneumatic cylinder 33, and lets the emplacer's circuit return to its original mode except for the label pressure foot circuit.

At approximately 335° from the start of stitching, (as shown in FIGS. 12 and 16) the stationary slide finger 56 makes contact with the vacuum conduit 25 on the label pressure foot 24 and slides the label pressure foot ahead of the stitching needle 12, thus preventing the needle from striking the vacuum conduit. The stationary slide finger 56 is assisted in moving the label pressure foot 24 by the pneumatic cylinder 33, which receives a burst of air pressure forcing the plunger 35 attached to the guide bar 23 to move to the right an adjustable distance. As the sewing machine is programmed for 363° of sewing, this allows the needle 12 to complete approximately 363° of stitching, whereby the finishing stitches overlap the starting stitches by 3°.

Figures 13, 17:
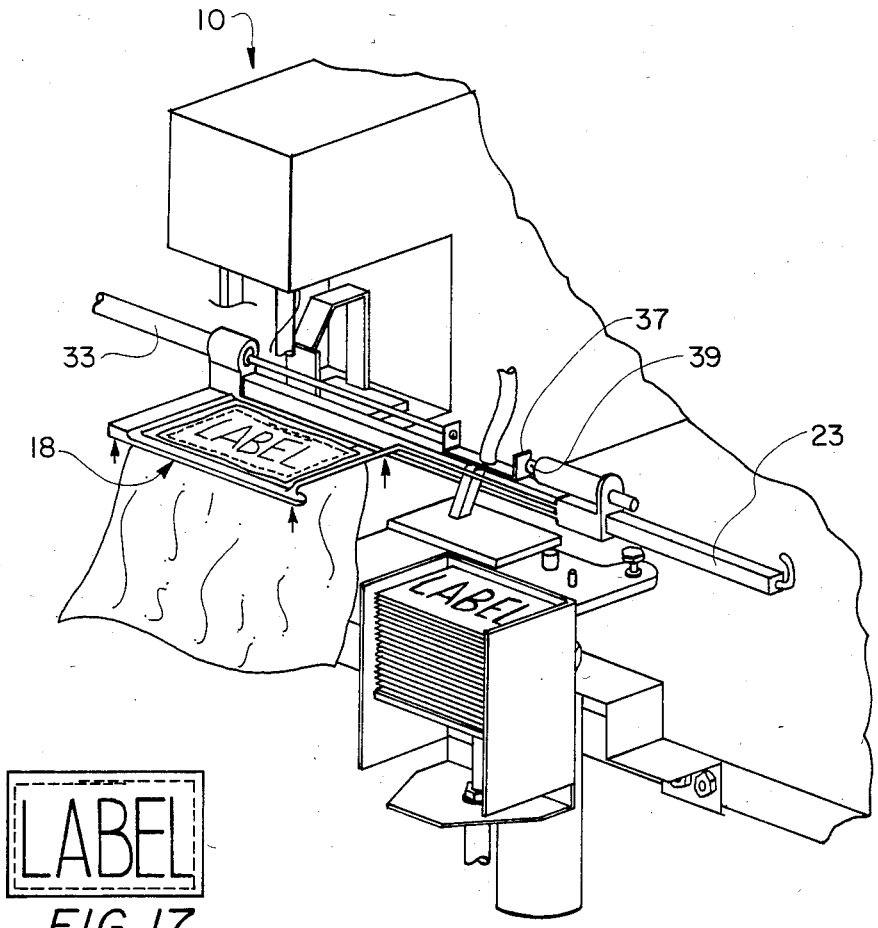

Upon completion of the stitching cycle (as shown in FIGS. 13 and 17) downward pressure is automatically removed from the pressure frame 18 and the guide bar 23 is shifted to the extreme right by means of the pneumatic cylinder 33, so that the stop 37 activates the switch 39, thus causing the treadle to be held in operative and the sewing machine 10 to revert back to its static mode.

As will be appreciated by those skilled in the art, the improved label dispenser cooperates with a simplified pressure frame that allows for a 360° or more stitching path circumscription of the label, thus providing an economical and reliable yet high quality device unavailable in the prior art. In addition, the label emplacer is designed for easy attachment to a commercially-available lock-stitch sewing machine.

Obviously, many modifications may be made without departing from the basic spirit of the present invention. Accordingly, within the scope of the appended claims, the invention may be practiced other than specifically disclosed herein.

What is claimed is:

1. In a sewing machine having a carrier means including a platen for supporting a workpiece, a reciprocating needle, and a supply of labels, a label emplacer comprising, in combination, a pressure frame mounted on the carrier means, means including a label pressure foot mounted on the pressure frame for lateral reciprocatory movement thereon and being adapted for selecting one of the labels from the label supply, means for transferring the label pressure foot and the said one label to a stitching position relative to the pressure frame, means for depressing the pressure frame along with the label pressure foot to securely retain the workpiece to the platen and the label to the workpiece, respectively, means for moving the pressure frame and the label pressure foot as a unit as the label is stitched to the workpiece by the reciprocating needle, and means for moving the label pressure foot out of the path of the reciprocating needle as the stitching of the label is being substantially completed.

2. In a sewing machine having a carrier means including a platen for supporting a workpiece, a reciprocating needle, and a supply of labels, a label emplacer comprising, in combination, a pressure frame mounted on the carrier means, means including a label pressure foot mounted on the pressure frame for lateral reciprocatory movement thereon and being adapted for selecting one of the labels from the label supply, means for transferring the label pressure foot and the said one label to a stitching position relative to the pressure frame, means for depressing the pressure frame along with the label pressure foot to securely retain the workpiece to the platen and the label to the workpiece, respectively, means for moving the pressure frame and the label pressure foot as a unit as the label is stitched to the workpiece by the reciprocating needle, and means for moving the label pressure foot out of the path of the reciprocating needle as the stitching of the label is being substantially completed, wherein the pressure frame includes spaced bosses having aligned guide ways formed therein, a guide bar mounted in the guideways for lateral reciprocatory movement therein, and means for mounting the label pressure foot on the guide bar between the spaced bosses.

3. The combination of claim 2, wherein the mounting means for the label pressure foot includes a vacuum conduit.

4. The combination of claim 3, wherein the label pressure foot has a substantially flat bottom surface provided with at least one orifice, whereby upon the application of a vacuum, the upper-most label in the label supply is selected and is retained on to the bottom surface of the label pressure foot.

5. In a sewing machine having a carrier means including a platen for supporting a workpiece, a reciprocating needle, and a supply of labels, a label emplacer comprising, in combination, a pressure frame mounted on the carrier means, means including a label pressure foot mounted on the pressure frame for lateral reciprocatory movement thereon and being adapted for selecting one of the labels from the label supply, means for transferring the label pressure foot and the said one label to a stitching position relative to the pressure frame, means for depressing the pressure frame along with the label pressure foot to securely retain the workpiece to the platen and the label to the workpiece, respectively, means for moving the pressure frame and the label pressure foot as a unit as the label is stitched to the workpiece by the reciprocating needle, and means for moving the label pressure foot out of the path of the reciprocating needle as the stitching of the label is being substantially completed, wherein the pressure frame includes a substantially rectangular portion having an opening therein, thereby allowing the label pressure foot to be received within the opening and into the confines of the portion of the pressure frame.

6. The combination of claim 5, wherein the pressure frame portion comprises a brace member connected to one of the bosses on the pressure frame and extending forwardly therefrom substantially perpendicularly thereof, an extension arm extending substantially parallel to the pressure frame and having a pair of ends, one of which is connected to the other of the bosses, a stabilizer arm connected to the other end of the extension arm and extending forwardly therefrom substantially parallel to the brace member, a pressure foot connected to the brace member and stabilizer arm, respectively, and the stabilizer arm being raised upwardly relative to the pressure foot, thereby forming the opening for receipt of the label pressure foot into the pressure frame.

7. The combination of claim 6, further including a pneumatic switch mounted on the pressure frame substantially adjacent to the other of the bosses, a stop carried by the guide bar, a pneumatic cylinder mounted on the pressure frame substantially adjacent to the one boss, a piston in the cylinder having an end extending therefrom substantially parallel to the guide bar, and means for mounting the end of the piston to the guide bar.

8. The combination of claim 7, wherein the means for mounting the end of the piston includes an adjustable bracket.

9. In a sewing machine for stitching a label to a workpiece, the combination of a pressure frame carried by the machine, a guide bar mounted on the machine for limited reciprocatory sliding movement relative to the pressure frame, a supply of labels, means including a label pressure foot carried by the guide bar for selecting one of the labels, means for reciprocating the guide bar and the label pressure foot relative to the machine, said last-named means including means for transferring the label pressure foot and the selected one label within the pressure frame, means for moving the pressure frame and the label pressure foot in a substantially rectangular pattern as the label is stitched to the workpiece, and means for retracting the label pressure foot out of the pressure frame when the label is stitched sufficiently to the workpiece to be retained thereon, further including means for providing an overlap beyond 360° in the stitching of the label to the workpiece.

10. In a sewing machine for stitching a label to a workpiece, the combination of a pressure frame carried by the machine, a guide bar mounted on the machine for limited reciprocatory sliding movement relative to the pressure frame, a supply of labels, means including a label pressure foot carried by the guide bar for selecting one of the labels, means for reciprocating the guide bar and the label pressure foot relative to the machine, said last-named means including means for transferring the label pressure foot and the selected one label within the pressure frame, means for moving the pressure frame and the label pressure foot in a substantially rectangular pattern as the label is stitched to the workpiece, and means for retracting the label pressure foot out of the pressure frame when the label is stitched sufficiently to the workpiece to be retained thereon and further including a label dispenser having a magazine for the supply of labels therein, means for raising the magazine upwardly within the dispenser, and means for raising the dispenser in timed sequence to allow the label pressure foot to select an uppermost label within the dispenser.

11. In a sewing machine having a carrier means including a platen for supporting a workpiece, a reciprocating needle, and a supply of labels, a label emplacer comprising, in combination, a pressure frame mounted on the carrier means, means including a label pressure foot mounted on the pressure frame for lateral reciprocatory movement thereon and being adapted for selecting one of the labels from the label supply, means for transferring the label pressure foot and the said one label to a stitching position relative to the pressure frame, means for depressing the pressure frame along with the label pressure foot to securely retain the workpiece to the platen and the label to the workpiece, respectively, means for moving the pressure frame and the label pressure foot as a unit as the label is stitched to the workpiece by the reciprocating needle, and means for moving the label pressure foot out of the path of the reciprocating needle as the stitching of the label is being substantially completed, wherein the means for moving the label pressure foot out of the path of the reciprocating needle includes a stationary slide finger.

12. A label emplacer and dispenser that is adaptable to a sewing machine including a platen, a supply of labels, a carrier means, a pressure frame mounted on the carrier means, a pressure foot mounted on the pressure frame, means for retracting the pressure foot, means for depressing the pressure frame and pressure foot, wherein the pressure frame includes spaced bosses having aligned guideways formed therein, a guide bar mounted in the guideways for lateral reciprocating movement therein, means for mounting the pressure foot on the guide bar between the spaced bosses, wherein the label pressure foot has a substantially flat bottom surface provided with at least one orifice, the pressure foot including a vacuum conduit, wherein the label pressure foot has a substantially flat bottom surface provided with at least one orifice, whereby upon application of a vacuum through the vacuum conduit, the uppermost label in the supply of labels is selected and is retained on the bottom surface of the label pressure foot.

13. The label emplacer and dispenser of claim 12 wherein the means for retracting the pressure foot includes a metal slide finger.

14. A label emplacer and dispenser that is adaptable to a sewing machine including a platen, a supply of labels, a carrier means, a pressure frame mounted on the carrier means, a pressure foot mounted on the pressure frame, means for retracting the pressure foot, means for depressing the pressure frame and pressure foot, wherein the pressure frame includes spaced bosses having aligned guideways formed therein, a guide bar mounted in the guideways for lateral reciprocating movement therein, means for mounting the pressure foot on the guide bar between the spaced bosses, wherein the label pressure foot has a substantially flat bottom surface provided with at least one orifice, the pressure foot including a vacuum conduit, and wherein the pressure frame includes a substantially rectangular portion having an opening therein, thereby allowing the label pressure foot to be received within the opening and into the confines of the portion of the pressure frame.

15. The label emplacer and dispenser of claim 14 wherein the means for retracting the pressure foot includes a metal slide finger.

16. A label emplacer and dispenser that is adaptable to a sewing machine including a platen, a supply of labels, a carrier means, a pressure frame mounted on the carrier means, a pressure foot mounted on the pressure frame, means for retracting the pressure foot, means for depressing the pressure frame and pressure foot, wherein the pressure frame includes spaced bosses having aligned guideways formed therein, a guide bar mounted in the guideways for lateral reciprocating movement therein, means for mounting the pressure foot on the guide bar between the spaced bosses, wherein the label pressure foot has a substantially flat bottom surface provided with at least one orifice, the pressure foot including a vacuum conduit, whereby upon application of a vacuum through the vacuum conduit the uppermost label in the supply of labels is selected and is retained on the bottom surface of the label pressure foot, further including a label dispenser having a magazine for the supply of labels therein, means for raising the magazine upwardly within the dispenser, and means for raising the dispenser in timed sequence to allow the label pressure foot to select an uppermost label within the dispenser.

17. The label emplacer and dispenser of claim 16 wherein the means for retracting the pressure foot includes a metal slide finger.

* * * * *